United States Patent [19]

Vanderstar

[11] 4,117,640

[45] Oct. 3, 1978

[54] THERMAL BARRIER SYSTEM FOR PANEL INSTALLATIONS

[76] Inventor: Cornelius Christian Vanderstar, 813 N. Foothill Rd., Beverly Hills, Calif. 90210

[21] Appl. No.: 776,992

[22] Filed: Mar. 14, 1977

[51] Int. Cl.[2] ..... E04B 1/62

[52] U.S. Cl. ..... 52/398; 52/730; 49/DIG. 1; 52/772; 52/775

[58] Field of Search ..... 52/498, 500, 501, 502, 52/397, 398, 235, 730, 731, 461, 464; 49/DIG. 1, DIG. 2; 24/221 R, 221 A, 73 D, 73 AM, 73 PF, 73 P

[56] References Cited

U.S. PATENT DOCUMENTS

| | | | |
|---|---|---|---|
| 2,898,643 | 4/1959 | Bush | 49/DIG. 1 |
| 3,004,636 | 10/1961 | Shane | 52/710 |
| 3,031,049 | 4/1962 | Somville | 52/730 |
| 3,191,727 | 6/1965 | Schmeltz | 49/DIG. 1 |
| 3,527,011 | 9/1970 | Bloom | 52/398 |
| 3,553,918 | 1/1971 | Daason | 52/464 |
| 4,015,388 | 4/1977 | Hemminger | 52/395 |

FOREIGN PATENT DOCUMENTS

| | | | |
|---|---|---|---|
| 2,005,438 | 12/1969 | France | 49/DIG. 1 |
| 2,130,496 | 12/1972 | Fed. Rep. of Germany | 52/398 |
| 1,179,607 | 1/1970 | United Kingdom | 54/498 |

*Primary Examiner*—Price C. Faw, Jr.
*Assistant Examiner*—Henry Raduazo
*Attorney, Agent, or Firm*—Herzig & Walsh, Inc.

[57] ABSTRACT

A thermal barrier system for panel installations comprises at least one gutter member attachable to a structure. The system further comprises a face member and a thermally insulative coupler member. The coupler member has an intermediate body portion to which are attached a pair of resilient legs which are rotatable into lockable engagement with a pair of slots defined in the gutter member. A second pair of resilient legs are attached to the intermediate body portion of the coupler member and are configured to snap into locking engagement with a pair of slots defined in the face member. The coupler is disengageable from the gutter and face members by a reverse rotation. Gaskets for engaging a panel between the face member and the gutter member are attached to the face member and the gutter member.

14 Claims, 5 Drawing Figures

THERMAL BARRIER SYSTEM FOR PANEL INSTALLATIONS

BACKGROUND OF THE INVENTION

1. Field of the Invention

The invention pertains generally to apparatus for holding panel members in conjunction with structures.

2. Description of the Prior Art

The use of metallic frames for panel installations on buildings has become widespread over the years. The advantages of metal frames for the panels are numerous. Among them are the durability and structural strength of such frames as well as their amenability to ornamental uses. There has been a substantial and continuing problem of insulation with respect to such panel installations due to the thermal conductivity of the metal, however.

Numerous prior art devices address themselves to the insulation problem of such panel installations. One such device is that described and claimed in U.S. Pat. No. 3,527,011 (Bloom, et al.) for insulating panels. Generally, the prior art devices utilize a combination of an insulative intermediate member joining the face and the other members of a panel installation. The individual components, however, do not allow for easy disengagement as is required for reglazing glass panels after breakage and for other panels for a variety of reasons.

Therefore, there has been a felt but unfulfilled need for a panel installation having thermal insulative properties having components which are relatively readily installable and removable.

DETAILED DESCRIPTION OF THE PREFERRED EMBODIMENT

Figure 1:
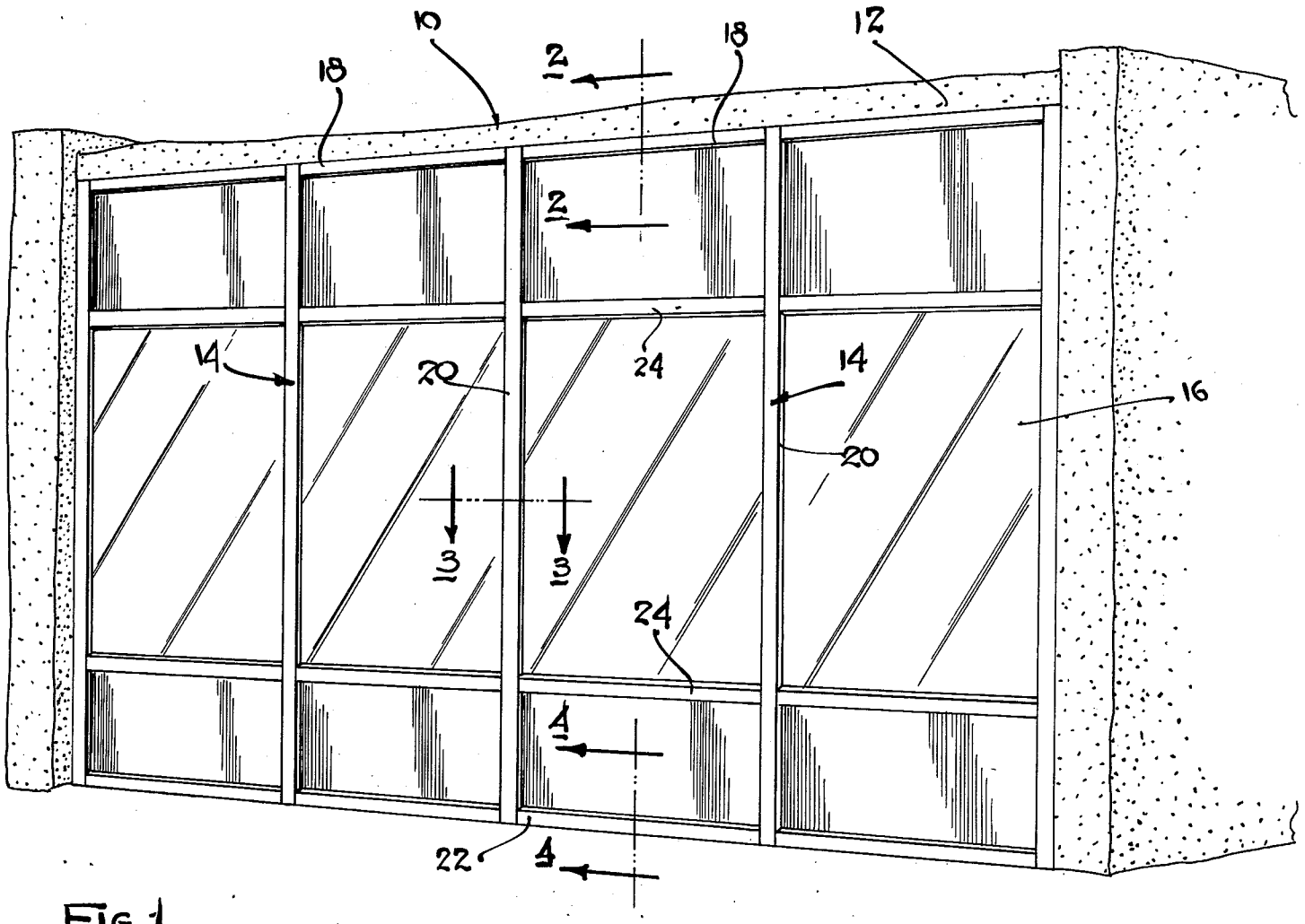
FIG. 1 is a perspective view of the exterior of a panel installation.
Figure 2:
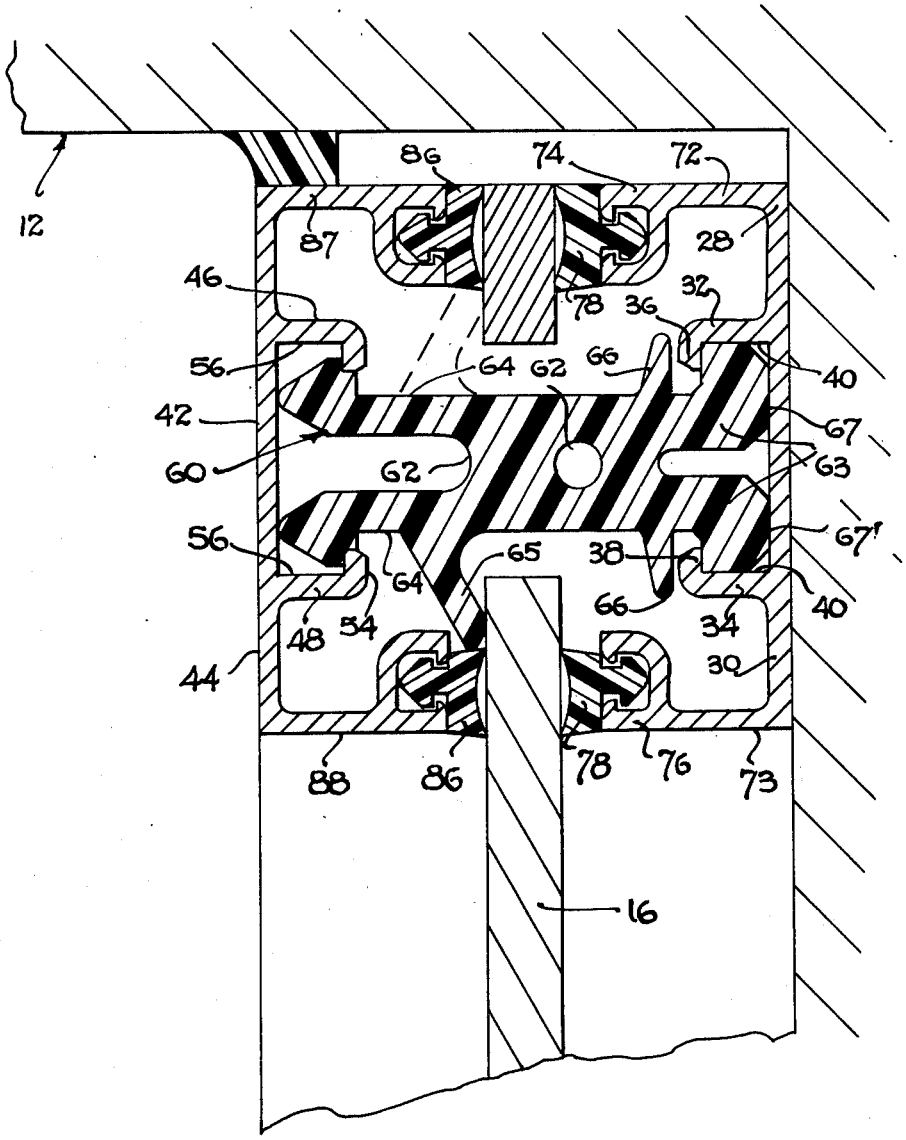
FIG. 2 is a sectional view of the panel installation of FIG. 1 along the line 2—2.
Figure 3:
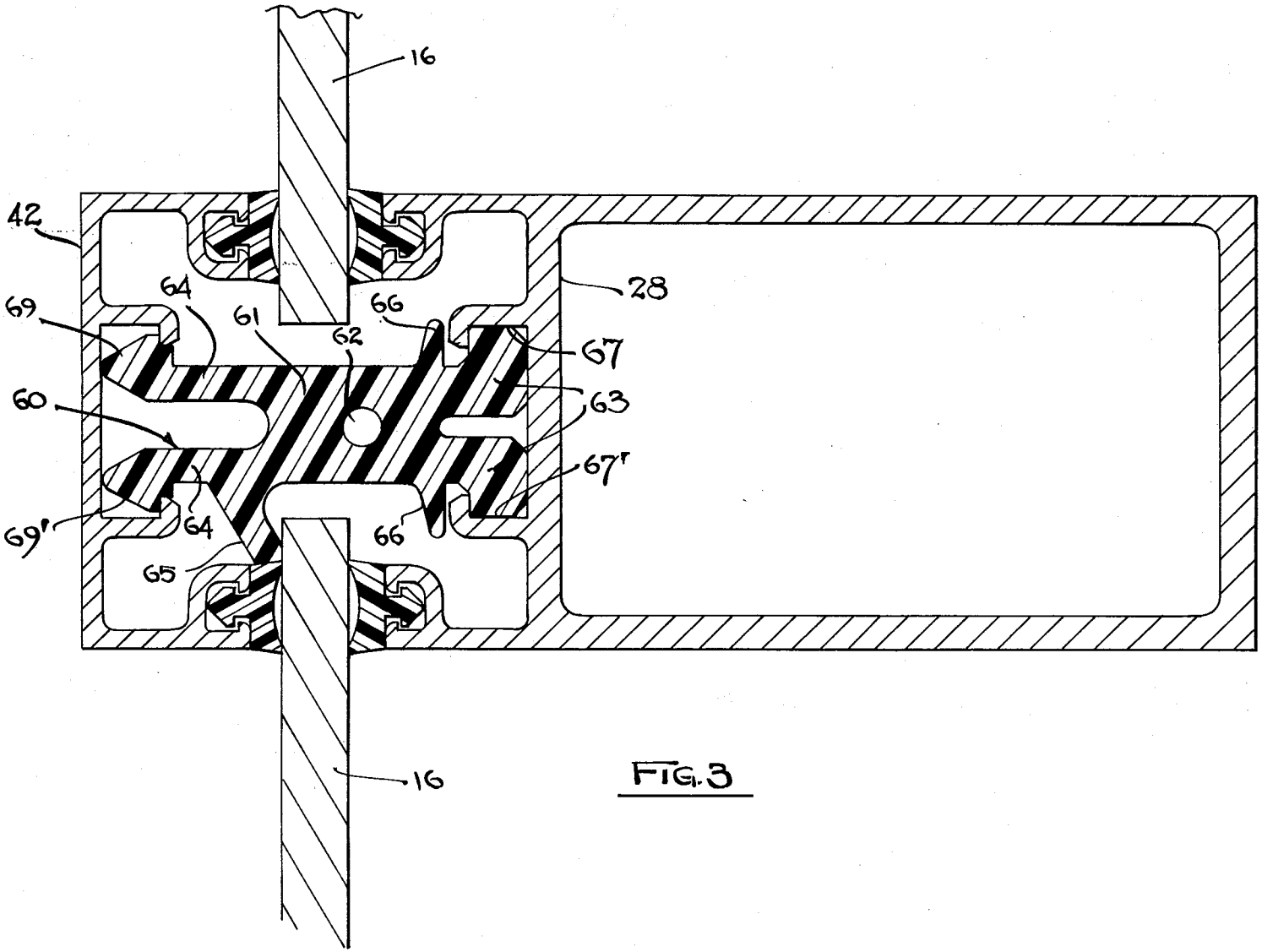
FIG. 3 is a sectional view of the panel installation of FIG. 1 taken along the line 3—3.

As depicted in FIGS. 1–5, a panel installation 10 is attached to a structure 12. Panel installation 10 comprises a plurality of frames 14. Each frame 14 contains an exterior panel 16. Panel 16 may comprise glass, as in the case of a window, or other type of panel deemed desirable for structural or ornamental purposes. Frames 14 are fabricated of aluminum or other metallic or thermally conductive material.

Hereinbelow, like parts will be referred to by like numerals and will be described with reference to one such like part. Frame 14 comprises an upper portion 18 joined to a pair of jambs 20, which are in turn joined to a sill 22. A pair of mullions 24 are joined to jambs 20 intermediately of upper portion 18 and sill 22.

The frame 14 comprises a gutter member 28 attachable by conventional means (not shown) to structure 12. Gutter member 28 comprises a rear wall 30 which is disposed adjacent structure 12. Gutter member 28 also includes an upper wall 32 and a lower wall 34, both joined to rear wall 30. Upper wall 32 includes a downwardly directed flange 36, and lower wall 34 includes an upwardly directed flange 38. The walls 30, 32, 34 and flanges 36, 38 form a pair of slots 40.

A face member 42 comprises the exterior surface of the frame 14. Face member 42 comprises a forward wall 44 and an upper wall and lower wall 46, 48, respectively. Upper wall 46 includes a downwardly directed flange 52 and wall 48 includes an upwardly directed flange 54. Walls 44, 46, 48 and flanges 52, 54 define a pair of slots 56.

A coupler member 60 is connected between gutter member 28 and face member 42. Coupler member 60 comprises a body portion 61 which defines an intermediate twist connector aperture 62. Coupler 60 includes first connector means comprising a first pair of legs 63; at the opposite end of coupler 60 is a second connector means comprising a second pair of legs 64. An arm 65, attached to coupler 60, extends inwardly to brace panel 16. A pair of shoulders 66 is attached to member 60 outwardly of legs 63.

First legs 63 include upper and lower ends 67, 67', respectively. Upper end 67 includes an upper surface having a rounded peripheral portion 68; lower end 67' has a similar rounded portion 68' disposed diagonally opposite to rounded portion 68. These rounded portions cooperate to permit ready assembly of the installation as described in detail below. Second legs 64 include upper and lower ends 69, 69', respectively. Ends 69, 69' taper outwardly. Upper and lower lips 70, 70' are disposed behind ends 69, 69', respectively. Upper lip 70 has an upper edge having a peripheral rounded portion 71. Lower lip 70' has a similar rounded portion (not shown) disposed diagonally opposite to rounded portion 71. The tapered ends 69, 69' facilitate assembly of the installation, and the rounded portions of lips 70, 70' permit convenient disengagement of legs 64 from face member 42 as described in detail below.

Coupler member 60 is fabricated of resilient insulated material, such as plastic. First legs 63 are of greater thickness than legs 64 and are spaced at a smaller distance from one another than are legs 64; legs 63 are less readily compressible together than are legs 64.

In the assembled condition, first legs 63 of the coupler member 60 are disposed in locking engagement with first slots 40, the legs being configured to fit snugly into said slots and being held in position by the resiliency of the material. Shoulders 66 are engaged against flanges 36, 38 and augment locking engagement of the coupler 60 with gutter member 28. Second legs 64 are configured to be disposed within second slots 56 and are held therein also by the resiliency of the material.

A pair of arms 72, 73 extend from the upper end and lower end, respectively, of gutter member 28. Arms 72, 73 include at their ends holders 74, 76, respectively. Held within holders 74, 76 are a pair of gaskets 78. Gaskets 78 are of resilient material, such as neoprene or polyvinylchloride, and are in contact with panel 16.

Figure 4:
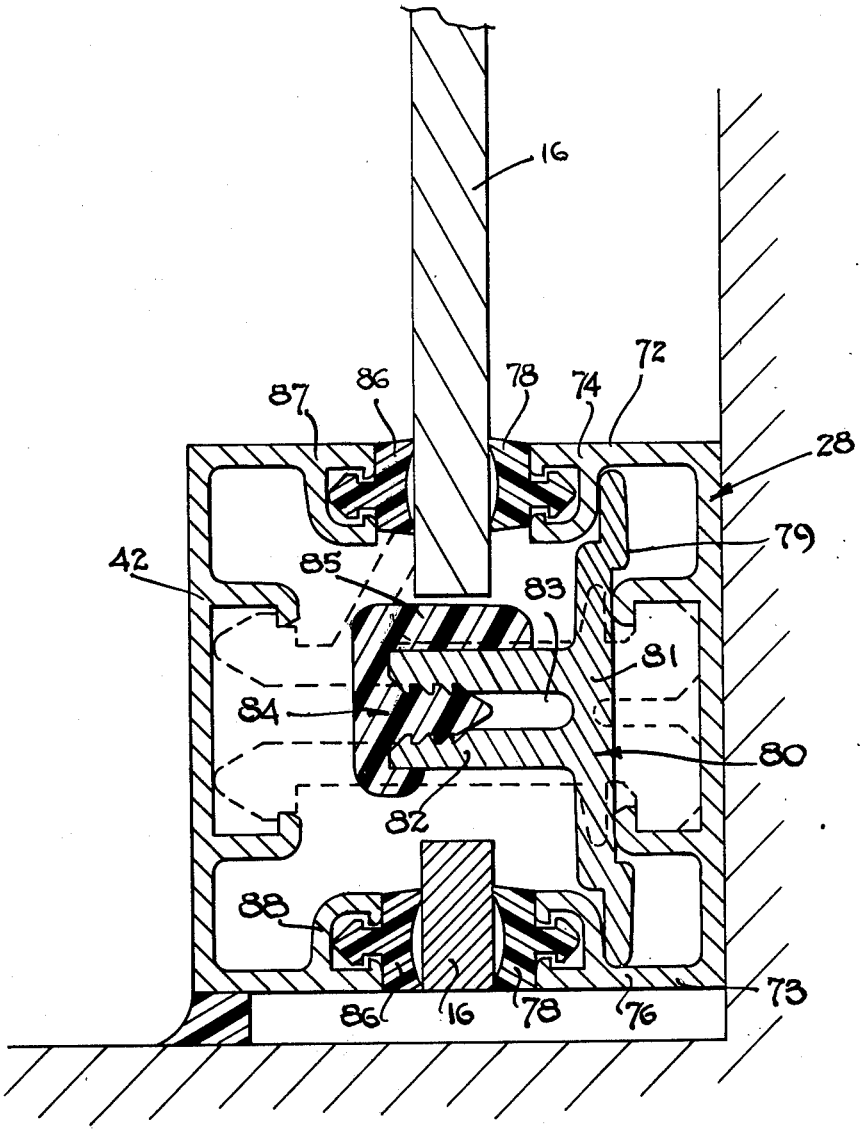
FIG. 4 is a sectional view of the panel installation of FIG. 1 taken along the line 4—4.
Figure 5:
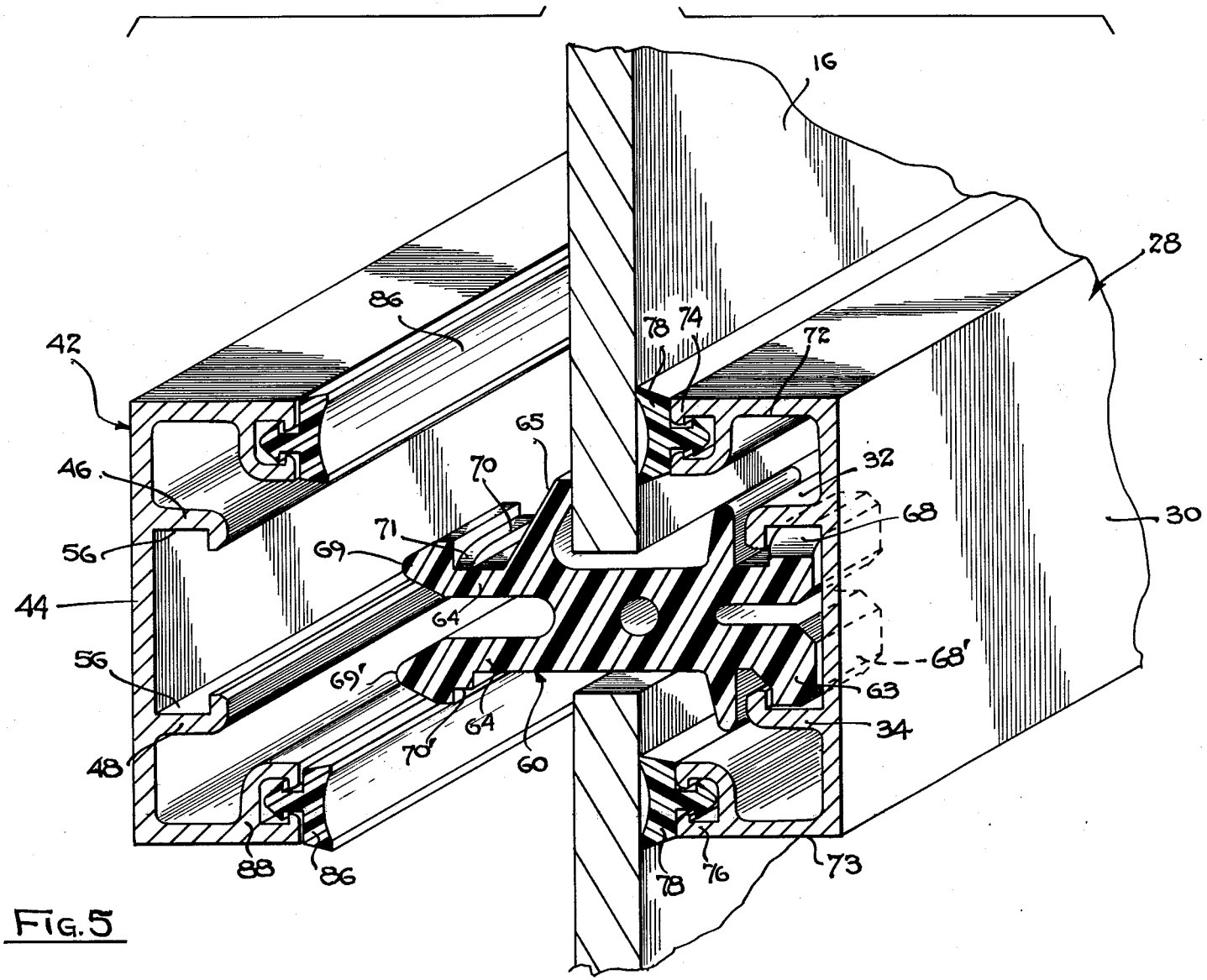
FIG. 5 is a fragmentary view of a portion of the panel installation of FIG. 1 in a partially assembled condition.

As depicted in FIG. 4, a support member 79 attached to gutter member 28 extends outwardly therefrom and under panel 16 to provide support thereto. Support member 79 includes a female element 80 comprising a pair of legs 81 which are mounted upon walls 32, 34 and between arms 72, 73. The female element 80 includes a bifurcated portion 82 defining a slot 83 and extending beneath panel 16. A male element 84 is mounted in slot 83 and includes a support portion 85 disposed in contact with the surface of the bifurcated portion 82 and the bottom of panel 16 to provide support therefor.

A pair of gaskets 86 contacts panel 16 and is disposed within a pair of holders 87, 88 disposed at upper and lower ends, respectively, of face member 42. Gaskets 86 are similar to gaskets 78 and act in conjunction therewith to brace panel 16.

Connection of the gutter member 28 and face member 42 with coupler member 60 to form a frame is readily accomplished. Coupler member 60 is positioned so that legs 63 are disposed sideways within slots 40. Legs 63 are then positioned into slots 40 by a substantially 90° rotation and remain in locked engagement therewith. Rounded portions 69, 69' move within the walls 32, 34 of slots 40 in conjunction with such positioning. Second legs 64 are placed into slots 56 by snapping the face member in place, flanges 52, 54 sliding along the tapered ends of legs 64 and compressing legs 64 together thereby. To disconnect the assembly, coupler 60 is rotated in a reverse sense with a wire or convenient flat tool engaged in the twist connector aperture 62. Rounded ends of lips 70, 70' slide along flanges 52, 54 to facilitate such disconnection. This disengages the coupler 60 from both the gutter member 28 and the face member 42 thus disassembling the frame 14. By thus using a flat tool to twist the coupler 60, the tool slips by the gaskets 78, 86 and the frame can be easily disassembled with the panel 16 remaining in place.

Thus, a thermally insulated panel installation having readily assembleable and disassembleable components is provided by the invention. Though a particular embodiment of the invention has been described and depicted above, the invention is defined solely by the appended claims.

What is claimed is:

1. A thermal barrier system for panel installations comprising:

at least one gutter member including means for attachment to a structure, said gutter member defining first forwardly facing slot means and including first flange means adjacent said first slot means;

at least one face member, said face member defining second rearwardly facing slot means and including second flange means adjacent said second slot means;

at least one coupler member comprising a unitary body of heat insulating material, the latter member having first connector means rotatable in one direction in said first slot means of said gutter member to form a locking engagement with said first slot means and said first flange means, said coupler member further including resilient second connector means snap fittable into said second slot means of said face member to form a locking engagement with said second slot means and said second flange means, said first connector means and said second connector means being disengageable from said gutter member and said face member, respectively, by a reverse rotation of said coupler member; and means adjacent said first and second slot means, respectively, for engaging and holding an edge of a panel member.

2. The invention as set forth in claim 1 wherein said coupler member includes shoulder means for contacting said first slot means and said first flange means to cooperate in forming said locking engagement of said first connector means with said gutter member.

3. The invention as set forth in claim 1 wherein said at least one face member comprises a plurality thereof, said at least one gutter member comprises a plurality thereof, and said at least one insulative coupler member comprises a plurality thereof, such that when said insulative coupler member is attached between said gutter member and said face member, they form a plurality of connected pairs, said plurality of connected pairs forming a frame for a panel.

4. The invention as set forth in claim 1 wherein said at least one coupler member defines an aperture for insertion of a twisting tool thereinto.

5. A thermal insulation system for panel installations comprising:

at least one gutter member, said gutter member including a first wall member and at least a pair of first flanges, said first wall member and said first flanges defining at least a first forwardly facing slot;

at least one face member, said face member including a second wall member and at least a pair of second flanges attached thereto, said second wall member and said at least one pair of second flanges defining at least a second rearwardly facing slot;

at least one coupler member, said coupler member comprising a unitary body of heat insulating material defining first connector means rotatable in said first slot of said gutter member into locking engagement with said first slot and with said pair of first flanges, said coupler member further including second connector means snap fittable into said second slot in said face member in locking engagement with said pair of second slots and with said pair of second flanges; and means adjacent said first and second slot means, respectively, for engaging and holding an edge of a panel member.

6. The invention as set forth in claim 5 wherein said coupler member comprises a body portion, wherein said first connector means comprises a pair of first legs attached to said body portion, and wherein said second connector means comprises a pair of second legs attached to said body portion, said first legs being configured to fit within said first slot means and being rotatable through a substantially 90° angle of rotation to form said locking engagement with said first slot means and said first flanges, said second legs being configured to fit within said second slot means and being resilient to be snappable into said locking engagement.

7. The invention as set forth in claim 6 wherein said first legs and said second legs are disengageable from said locking engagement by a reverse rotation of said coupler member.

8. The invention as set forth in claim 6 further including a pair of shoulder members on said body portion, said shoulder members being resilient and positioned to contact said first flanges in locking engagement therewith when said first legs are in said locking engagement in said first slots.

9. The invention as set forth in claim 6 wherein said coupler member includes a pair of lip means, each of said lip means being disposed adjacent one of said second legs, for contacting said second flanges when said second legs are in locking engagement with said face member to permit motion of said second legs when said coupler member is rotated.

10. The invention as set forth in claim 7 wherein said first legs include portions configured to permit motion of said first legs within said first slots upon rotation of said coupler member.

11. The invention as set forth in claim 1 wherein said gutter member includes gasket means for engaging a panel between said face member and said gutter member.

12. The invention as set forth in claim 1 wherein said at least one face member includes gasket means for engaging a panel between said face member and said gutter member.

13. The invention as set forth in claim 6 wherein said coupler member defines an aperture within said body portion thereof for insertion of a twisting tool thereinto.

14. The invention as set forth in claim 6 further including a support member for contacting a lower end of a panel, said support member being mountable upon said first flanges.

* * * * *